US011508350B2

(12) United States Patent
Lee et al.

(10) Patent No.: US 11,508,350 B2
(45) Date of Patent: Nov. 22, 2022

(54) APPARATUS FOR SYNTHESIZING ENGINE SOUND

(71) Applicant: LG ELECTRONICS INC., Seoul (KR)

(72) Inventors: Byounggi Lee, Seoul (KR); Kihyun Kim, Seoul (KR); Kyuho Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/294,351

(22) PCT Filed: Nov. 13, 2019

(86) PCT No.: PCT/KR2019/015443
§ 371 (c)(1),
(2) Date: May 14, 2021

(87) PCT Pub. No.: WO2020/101346
PCT Pub. Date: May 22, 2020

(65) Prior Publication Data

US 2022/0013100 A1 Jan. 13, 2022

(30) Foreign Application Priority Data

Nov. 14, 2018 (KR) ..... 10-2018-0139506

(51) Int. Cl.
*G10K 15/02* (2006.01)
*G10K 11/178* (2006.01)

(52) U.S. Cl.
CPC ..... *G10K 11/178* (2013.01); *G10K 15/02* (2013.01); *G10K 2210/121* (2013.01); *G10K 2210/1282* (2013.01); *G10K 2210/3026* (2013.01)

(58) Field of Classification Search
CPC ..... G10K 15/02
See application file for complete search history.

(56) References Cited

U.S. PATENT DOCUMENTS

2005/0113168 A1 5/2005 Maeda
2012/0275612 A1 11/2012 Vogel et al.

FOREIGN PATENT DOCUMENTS

JP H10277263 10/1998
JP 2001290489 10/2001
(Continued)

OTHER PUBLICATIONS

English machine translation of JP 2007256527, 40 pages (Year: 2007).*

(Continued)

*Primary Examiner* — Ping Lee
(74) *Attorney, Agent, or Firm* — Lee, Hong, Degerman, Kang & Waimey PC

(57) ABSTRACT

An apparatus for synthesizing an engine sound according to an embodiment of the present invention comprises: a memory for storing a plurality of explosion sound samples corresponding to a plurality of cylinders included in a cylinder module, respectively; a sound output unit; and a processor for calculating explosion periods of the plurality of cylinders, and overlapping the plurality of samples stored according to the calculated explosion periods on explosion noises of corresponding cylinders, respectively, to output a synthesized virtual engine sound through the sound output unit.

6 Claims, 8 Drawing Sheets

(56) References Cited

FOREIGN PATENT DOCUMENTS

| | | |
|---|---|---|
| JP | 2007256527 | 10/2007 |
| JP | 2009064028 | 3/2009 |
| KR | 101588493 | 1/2016 |

OTHER PUBLICATIONS

English machine translation of JP 2000010576, 17 pages (Year: 2000).*
PCT International Application No. PCT/KR2019/015443, International Search Report dated Feb. 21, 2020, 4 pages.

* cited by examiner

600

700

800

APPARATUS FOR SYNTHESIZING ENGINE SOUND

CROSS-REFERENCE TO RELATED APPLICATIONS

This application is the National Stage filing under 35 U.S.C. 371 of International Application No. PCT/KR2019/015443, filed on Nov. 13, 2019 which claims the benefit of Korean Application No. 10-2018-0139506 filed on Nov. 14, 2018, the contents of which are all hereby incorporated by reference herein in their entirety.

TECHNICAL FIELD

The present invention relates to an apparatus for synthesizing an engine sound, and more particularly, to an apparatus for synthesizing an engine sound, which artificially synthesizes a virtual engine sound by using an engine motion principle of a vehicle.

BACKGROUND ART

There are already known many methods for generating artificial engine noises that complement the existing engine noise of the automobile to make the overall pleasant engine sound.

In such a method, the existing engine noise is supplemented by the generated auxiliary noise to make the engine sound that is pleasant to the interior. For this, engine conditions and current engine noises under the engine conditions are detected through a microphone and/or vibration sensor mounted on the engine and through a load signal.

Vehicle driving noises corresponding to the detected engine conditions, for example, sports sounds may be read out from an audio memory and then may be heard in addition to the current engine noises in the interior through speakers or electromechanical actuators.

As the patent related to generation of virtual engine noises, there is Korean Patent Publication No. KR10-1588493.

In Korean Patent Application Publication No. KR10-1588493, noises are artificially generated using signal samples.

However, in the related art, it was not possible to generate the virtual noises that are suitable for an explosion period of the engine, and thus it was not possible to accurately output an operation state of the engine.

INVENTION

Technical Problem

An object of the present invention is to provide an apparatus for synthesizing an engine sound, which is capable of outputting a dynamic virtual engine sound that is suitable for an operation of an engine by using an operation principle of the vehicle engine.

An object of the present invention is to provide an apparatus for synthesizing an engine sound, which is capable of outputting a virtual engine sound by reflecting vehicle state information or a driver's driving situation.

Technical Solution

An apparatus for synthesizing an engine sound according to an embodiment of the present invention may calculate an explosion period of a cylinder module and allow a plurality of samples, which are previously stored according the explosion period, to superimpose an explosion noise of a corresponding cylinder, thereby outputting a synthesized virtual engine sound.

An apparatus for synthesizing an engine sound according to an embodiment of the present invention may acquire a gain suitable for vehicle state information, adjust a size of an explosion sound sample according to the acquired gain, and output a virtual engine sound, in which the adjusted explosion sound sample is superimposed to the explosion noise of a cylinder.

The additional scope of the applicability of the present invention will become apparent from the detailed description below. However, the various changes and modifications within the spirit and scope of the present invention may be clearly understood by those skilled in the art, and thus, specific embodiments such as the detailed description and the preferred embodiments of the present invention should be understood as given only as examples.

Effect of the Invention

According to the embodiment of the present invention, the driver of the vehicle may hear the engine sound appropriate to the time point when the engine is driven to feel audible fun.

In addition, pedestrians around the vehicle or drivers adjacent to the vehicle may more easily recognize the driving situation of the vehicle through the vehicle engine sound of the vehicle.

BEST MODE

Hereinafter, embodiments disclosed in this specification is described with reference to the accompanying drawings, and the same or corresponding components are given with the same drawing number regardless of reference number, and their duplicated description will be omitted. Furthermore, terms, such as a "module" ad a "unit", are used for convenience of description, and they do not have different meanings or functions in themselves. Moreover, detailed descriptions related to well-known functions or configurations will be ruled out in order not to unnecessarily obscure subject matters of the present disclosure. However, this does not limit the present disclosure within specific embodiments and it should be understood that the present disclosure covers all the modifications, equivalents, and replacements within the idea and technical scope of the present disclosure.

It will be understood that although the ordinal numbers such as first and second are used herein to describe various elements, these elements should not be limited by these numbers. The terms are only used to distinguish one component from other components.

It will also be understood that when an element is referred to as being "connected to" or "engaged with" another element, it can be directly connected to the other element, or intervening elements may also be present. It will also be understood that when an element is referred to as being 'directly connected to' another element, there is no intervening elements.

The terms of a singular form may include plural forms unless referred to the contrary. In this application, the terms "comprises" or "having" are intended to indicate that there is a feature, number, step, operation, component, part, or combination thereof described in the specification, and one or more other features. It is to be understood that the present invention does not exclude the possibility of the presence or the addition of numbers, steps, operations, components, components, or a combination thereof.

Figure 1:
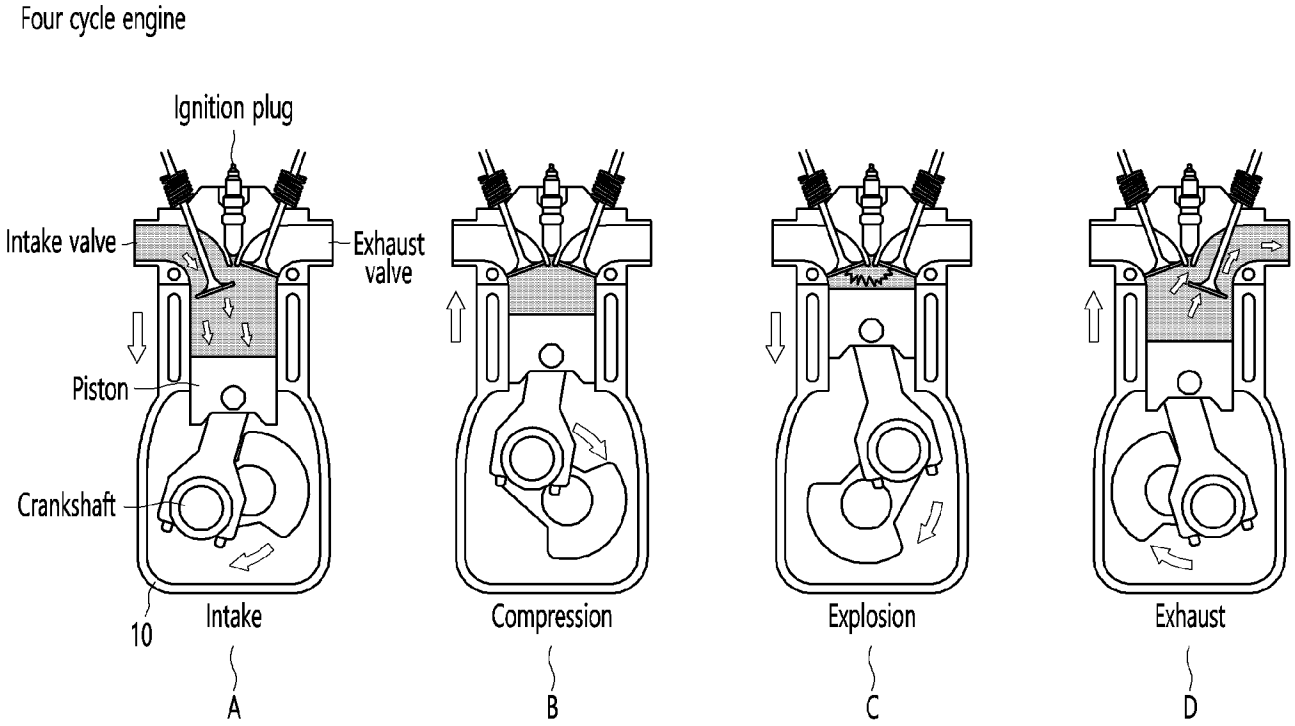
FIG. 1 is a view for explaining an operation principle of a vehicle according to a related art.

FIG. 1 is a view for explaining an operation principle of a vehicle according to a related art.

Referring to FIG. 1, an operation principle of a four-cycle engine (or four-stroke engine), which is an internal combustion engine of a vehicle, is illustrated.

The stroke means that all pistons in a cylinder vertically move in one direction.

The four-stroke engine is configured to perform a process in which a cylinder 10 illustrated in FIG. 1 performs four strokes of an intake operation A, a compression operation B, an explosion operation C, and an exhaust operation D to complete one cycle.

Until one cycle of the four-stroke engine is completed, the crankshaft rotates twice.

In case of four cylinders, in order to balance the engine, explosions do not occur simultaneously in each of the cylinders, but occur in order of a first cylinder, a second cylinder, a fourth cylinder, and a third cylinder. However, this is merely an example in order.

In case of six cylinders, explosions occur in order of a first cylinder, a fifth cylinder, a third cylinder, a sixth cylinder, a second cylinder, and a fourth cylinder. However, this is merely an example in order.

In an embodiment of the present invention, a process in which an explosion sound sample of each of the cylinders is adapted for the number of revolutions of a crankshaft per minute (hereinafter, referred to as an RPM) to superimpose noises of the existing cylinders, thereby outputting a synthesized engine noise by using an operation principle of the vehicle engine.

Figure 2:
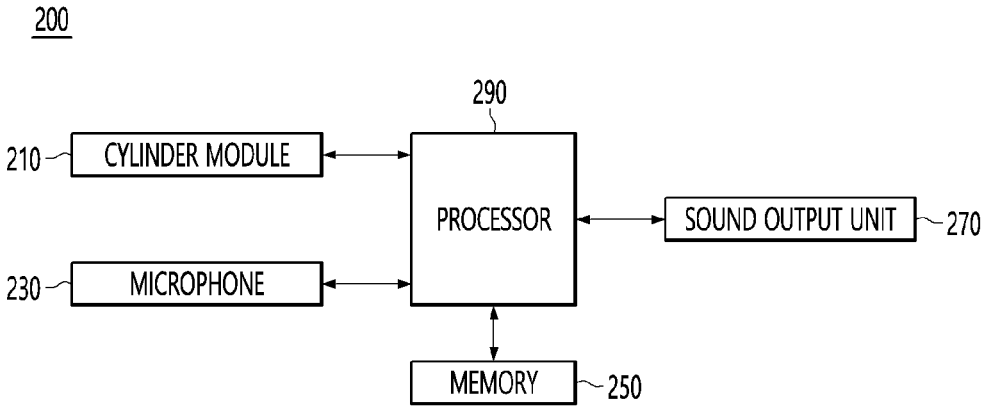
FIG. 2 is a block diagram for explaining a configuration of an apparatus for synthesizing an engine sound according to an embodiment of the present invention.

FIG. 2 is a block diagram for explaining a configuration of an apparatus for synthesizing an engine sound according to an embodiment of the present invention.

An apparatus 200 for synthesizing an engine sound, which is described in FIG. 2, may be included in a vehicle.

Referring to FIG. 2, the apparatus 200 for synthesizing the engine sound may include a cylinder module 210, a microphone 230, a memory 250, a sound output unit 270, and a processor 290.

The cylinder module 210 may include a plurality of cylinders.

When the cylinder module 210 is provided in a four-cylinder type, four cylinders may be included, and in case of a six-cylinder type, six cylinders may be included.

The microphone 230 may collect a plurality of explosion sound samples, which respectively correspond to the plurality of cylinders included in the cylinder module 210.

The microphone 230 processes external sound signals as electrical voice data.

Various noise canceling algorithms for removing noises occurring during reception of external sound signals may be implemented in the microphone 230.

The memory 250 may store the explosion sound samples generated when each of the plurality of cylinders performs an explosion operation.

The sound output unit 270 may output an audio signal.

Particularly, the sound output unit 270 may output a virtual engine sound in which the explosion sound sample corresponding to each of the cylinders and an actual explosion noise of the cylinder are superimposed.

The processor 290 may control an operation of components of the apparatus 200 for synthesizing the engine sound.

The processor 290 may calculate an explosion period of the cylinder module 210.

The processor 290 may sequentially superimpose the plurality of explosion sound samples stored in the memory 250 with the noises of the corresponding cylinders according to the calculated explosion period.

The processor 290 may output the synthesized virtual engine sound through the sound output unit 270 according to the superimposed result.

The processor 290 may acquire vehicle state information, which is information necessary to adjust a size of the explosion sound sample.

The processor 290 may calculate a gain according to the acquired state information of the vehicle.

The processor 290 may adjust the size of the explosion sound sample to be superimposed to correspond to the calculated gain.

The processor 290 may superimpose the explosion sound sample, which is adjusted in size, with the noise of the corresponding cylinder according to the explosion cycle.

Figure 3:
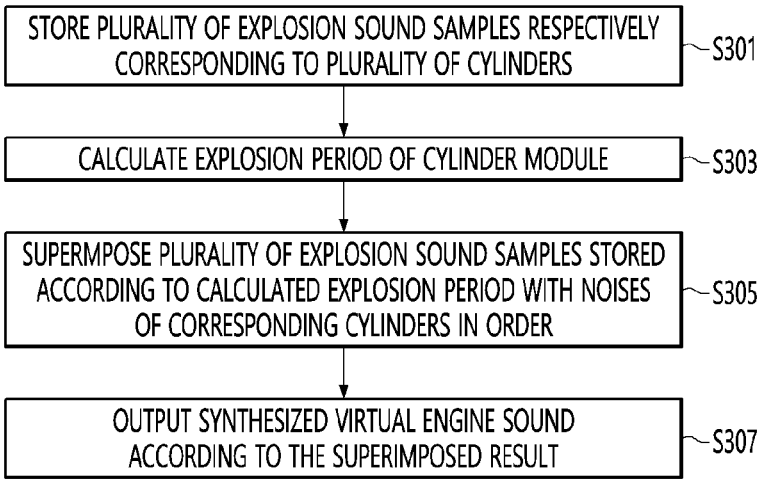
FIG. 3 is a flowchart for explaining an operation method of the apparatus for synthesizing the engine sound according to an embodiment of the present invention.

FIG. 3 is a flowchart for explaining an operation method of the apparatus for synthesizing the engine sound according to an embodiment of the present invention.

In the following embodiment, the cylinder module 210 is described being assumed that the four-cylinder type including four cylinders is used, but may also be applied to the six-cylinder type including six cylinders.

Referring to FIG. 3, a processor 290 of an apparatus 200 for synthesizing an engine sound stores a plurality of explosion sound samples respectively corresponding to a plurality of cylinders in a memory 250 (S301).

In an embodiment, the processor 290 may store the explosion sound samples, which are generated when each of the plurality of cylinders performs an explosion operation, in the memory 250.

For this, the processor 290 may collect the explosion sound samples generated when each of the plurality of cylinders performs an explosion operation through the microphone 230.

For example, when a first cylinder performs the explosion operation, the processor 290 may collect a first explosion noise input through the microphone 230 as a first explosion sound sample.

Similarly, when a second cylinder performs the explosion operation, the processor 290 may collect a second explosion noise input through the microphone 230 as a second explosion sound sample, when a third cylinder performs the explosion operation, the processor 290 may collect a third explosion noise input through the microphone 230 as a third explosion sound sample, and when a fourth cylinder performs the explosion operation, the processor 290 may collect a fourth explosion noise input through the microphone 230 as a fourth explosion sound sample.

The processor 290 may store the collected first to fourth explosion sound samples in the memory 250.

The processor 290 may match and store each of the first to fourth explosion sound samples with an identifier of each of the first to fourth cylinders. This is a reason for superimposing the explosion sound sample corresponding to the noise of the corresponding cylinder.

In case of the four-cylinder type, four explosion sound samples may be stored. In case of the six-cylinder type, six explosion sound samples may be stored in the memory 250.

The processor 290 of the apparatus 200 for synthesizing the engine sound calculates an explosion period of the cylinder module 210 (S303).

In an embodiment, the explosion cycle may be calculated based on RPM, the number of revolutions of a crankshaft, which is included in each cylinder, per cycle, and the number of explosions per cycle.

First, the processor 290 may calculate the number of explosions per second in the four-cylinder type.

If calculating the number of explosions per second in the four-cylinder type, it may be calculated as follows.

The number of explosions in four-cylinder type per second=(the number of revolutions of crankshaft/60 s)/(the number of revolutions of crankshaft per cycle)×(the number of explosions per cycle)=(RPM/60/2)*4

As a result, the explosion period in the four-cylinder type may be calculated as 1/(the number of explosions per second in four-cylinder type).

If the cylinder module 210 is provided in the six-cylinder type using six cylinders, the number of explosions per second in the six-cylinder type may be calculated as follows.

The number of explosions in six-cylinder type per second=(the number of revolutions of crankshaft/60 s)/(the number of revolutions of crankshaft per cycle)×(the number of explosions per cycle)=(RPM/60/2)*6

As a result, the explosion period in the six-cylinder type may be calculated as 1/(the number of explosions per second in six-cylinder type).

In this way, the processor 290 may calculate the explosion period of the cylinder module 210.

The processor 290 sequentially superimposes the plurality of explosion sound samples stored in the memory 250 with the noises of the corresponding cylinders according to the calculated explosion period (S305).

The processor 290 may superimpose the stored explosion sound samples according to the calculated explosion period with the noises of the cylinders in order of explosion.

This will be described with reference to FIG. 4.

Figure 4:
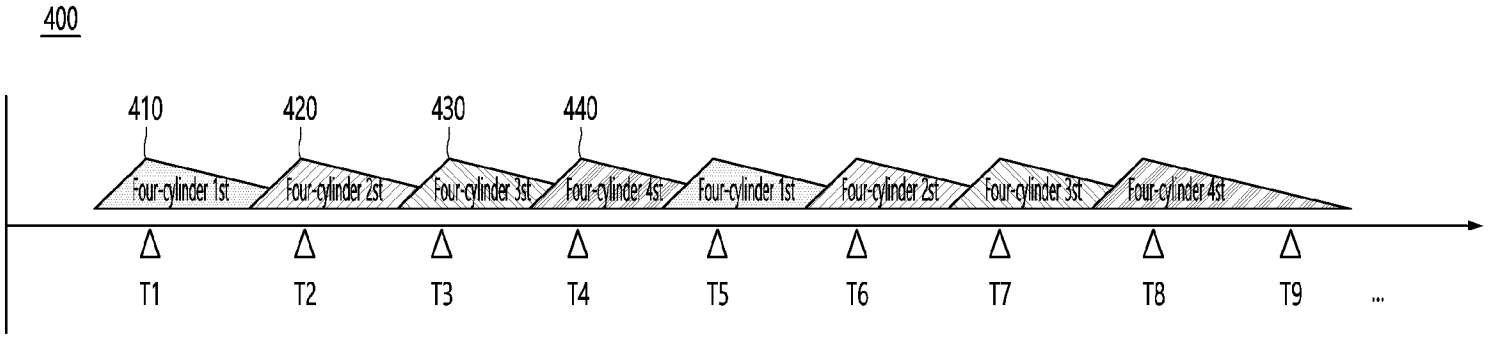
FIG. 4 is a view for explaining an example in which explosion sound samples are superimposed according to an explosion period in a four-cylinder type according to an embodiment of the present invention.

FIG. 4 is a view for explaining an example in which the explosion sound samples are superimposed according to the explosion period in the four-cylinder type according to an embodiment of the present invention.

The four-cylinder type cylinder module 210 may include first to fourth cylinders. In addition, it is assumed that the explosions occur in order of a first cylinder, a second cylinder, a third cylinder, and a fourth cylinder.

The processor 290 may superimpose a first explosion sound sample 410 corresponding to the first cylinder with an explosion noise of the first cylinder at a first explosion time point T1. For this, the processor 290 may extract the first explosion sound sample through the memory 250 before the first explosion time point T1.

That is, the processor 290 may superimpose the first explosion sound sample 410 previously stored with the explosion noise of the first cylinder at a timing of an explosion stroke operation of the first cylinder to output the superimposed result.

Similarly, the processor 290 may superimpose a second explosion sound sample 420 corresponding to the second cylinder with an explosion noise of the second cylinder at a second explosion time point T2. That is, the processor 290 may superimpose the second explosion sound sample 420 previously stored with the explosion noise of the second cylinder at a timing of an explosion stroke operation of the second cylinder to output the superimposed result.

A time difference between the second explosion time point T2 and the first explosion time point T1 may be as much as the explosion period calculated in operation S303.

Similarly, the processor 290 may superimpose a third explosion sound sample 430 corresponding to the third cylinder with an explosion noise of the third cylinder at a third explosion time point T3. That is, the processor 290 may superimpose the third explosion sound sample 430 previously stored with the explosion noise of the third cylinder at a timing of an explosion stroke operation of the third cylinder to output the superimposed result.

Similarly, the processor 290 may superimpose a fourth explosion sound sample 440 corresponding to the fourth cylinder with an explosion noise of the fourth cylinder at a second explosion time point T4. That is, the processor 290 may superimpose the fourth explosion sound sample 440 previously stored with the explosion noise of the fourth cylinder at a timing of an explosion stroke operation of the fourth cylinder to output the superimposed result.

Again, FIG. 3 will be described.

The processor 290 outputs the synthesized virtual engine sound through the sound output unit 270 according to the superimposed result (S307).

For example, the processor 290 may generate the synthesized virtual engine sound by superimposing the first explosion sound sample corresponding to the first cylinder with the explosion noise that is actually output by the first cylinder at the first explosion time point T1. The processor 290 may output the generated virtual engine sound through the sound output unit 270.

Thus, the driver of the vehicle may hear the engine sound corresponding to the time point of the engine driving. In addition, pedestrians around the vehicle or drivers adjacent to the vehicle may more easily recognize the driving situation of the vehicle through the vehicle engine sound of the vehicle.

Next, an operation method of an apparatus for synthesizing an engine sound according to another embodiment of the present invention will be described.

Figure 5:
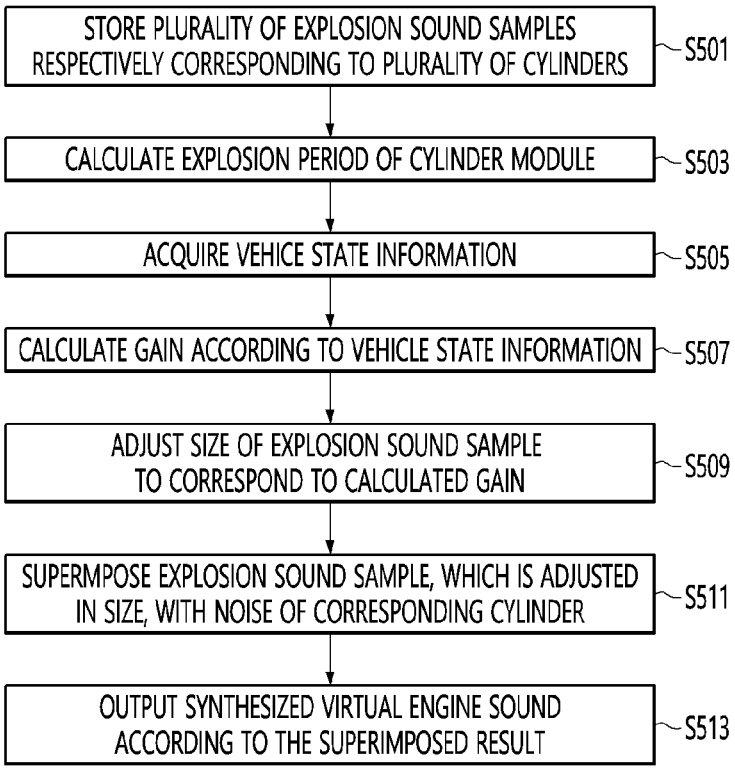
FIG. 5 is a flowchart for explaining an operation method of an apparatus for synthesizing an engine sound according to another embodiment of the present invention.

FIG. 5 is a flowchart for explaining an operation method of an apparatus for synthesizing an engine sound according to another embodiment of the present invention.

Hereinafter, in the operation method of the apparatus 200 for synthesizing the engine sound according to another embodiment, detailed descriptions of portions overlapping with those of FIG. 3 will be omitted.

A processor 290 of the apparatus 200 for synthesizing the engine sound stores a plurality of explosion sound samples respectively corresponding to a plurality of cylinders in a memory 250 (S501).

The processor 290 of the apparatus 200 for synthesizing the engine sound calculates an explosion period of the cylinder module 210 (S503).

The processor 290 of the apparatus 200 for synthesizing the engine sound acquires vehicle state information, which is information necessary to adjust a size of each of the explosion sound samples (S505).

In an embodiment, the vehicle state information may include one or more of an RPM, an engine load state, a vehicle speed, an accelerator pedal effect (push force), a brake pedal effort, and a gear state.

The load condition of the engine may represent a degree to which an engine is loaded. The load condition of the engine may include an overload condition, a heavy load condition, and a low load condition.

The accelerator pedal effort may represent force exerted by a driver on an accelerator pedal.

The brake pedal effort may represent force exerted by the driver on the brake pedal.

The gear state may represent whether at what stage the vehicle's gear is placed.

The processor 290 may measure a vehicle speed by using a speed sensor provided in the apparatus 200 for synthesizing the engine sound.

The processor 290 may measure the RPM of the vehicle using an RPM measurement sensor provided in the apparatus 200 for synthesizing the engine sound. Either a proximity sensor or an encoder may be used as the RPM measurement sensor.

The processor 290 may measure an accelerator pedal effort or a brake pedal effort through a pedal effort measurement sensor provided in the vehicle.

According to an embodiment of FIG. 3, regardless of the vehicle state information, the size of the explosion sound sample to be superimposed is fixed.

However, when the size of the explosion sound sample is adjusted according to the state information of the vehicle, it may be output that the engine is a dynamic engine suitable for the state of the vehicle or the driving state of the driver.

The processor 290 of the apparatus 200 for synthesizing the engine sound calculates a gain according to the acquired state information of the vehicle (S507).

In an embodiment, the processor 290 may calculate the gain using at least one of the RPM, the vehicle speed, or the accelerator pedal effort.

The processor 290 may calculate the gain by using at least one of a first element gain corresponding to the RPM, a second element gain corresponding to the vehicle speed, and a third element gain corresponding to the accelerator pedal effort.

This will be described with reference to FIGS. 6 to 8.

Figure 6:
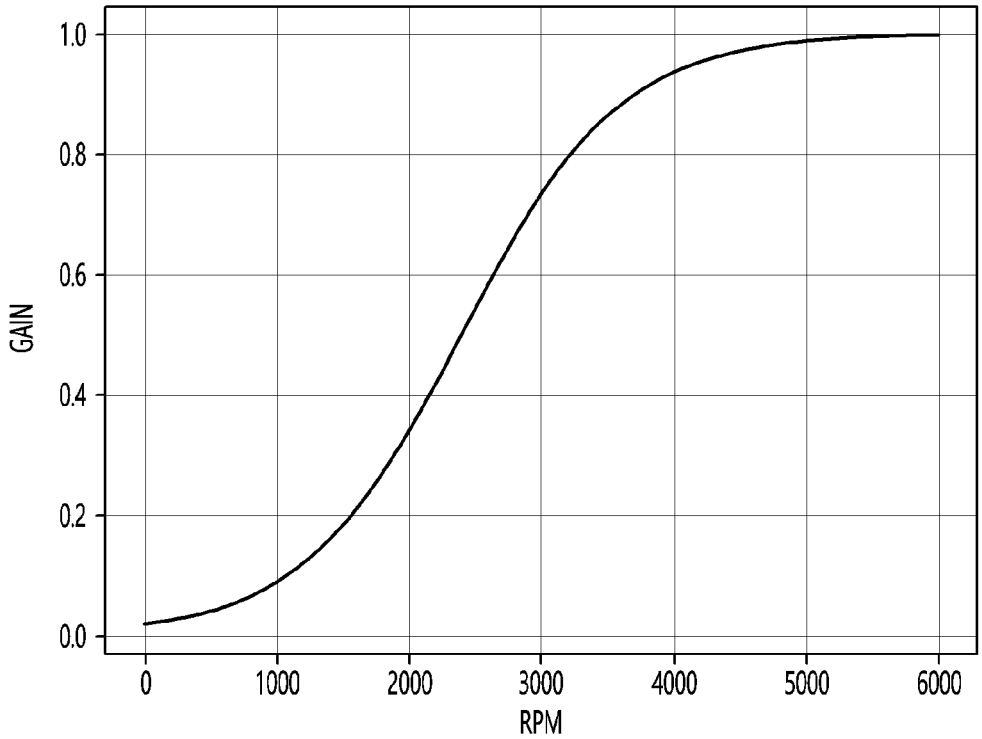
FIGS. 6 to 8 are views illustrating a variation in gain corresponding to state information of a vehicle according to an embodiment of the present invention.
Figure 7:
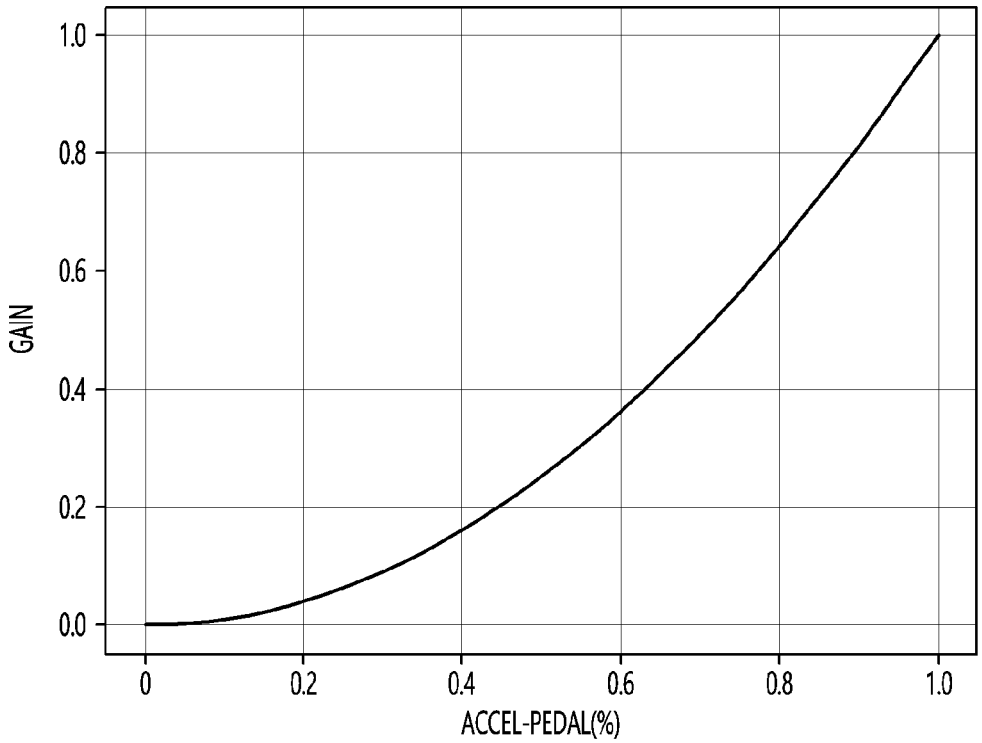
Figure 8:
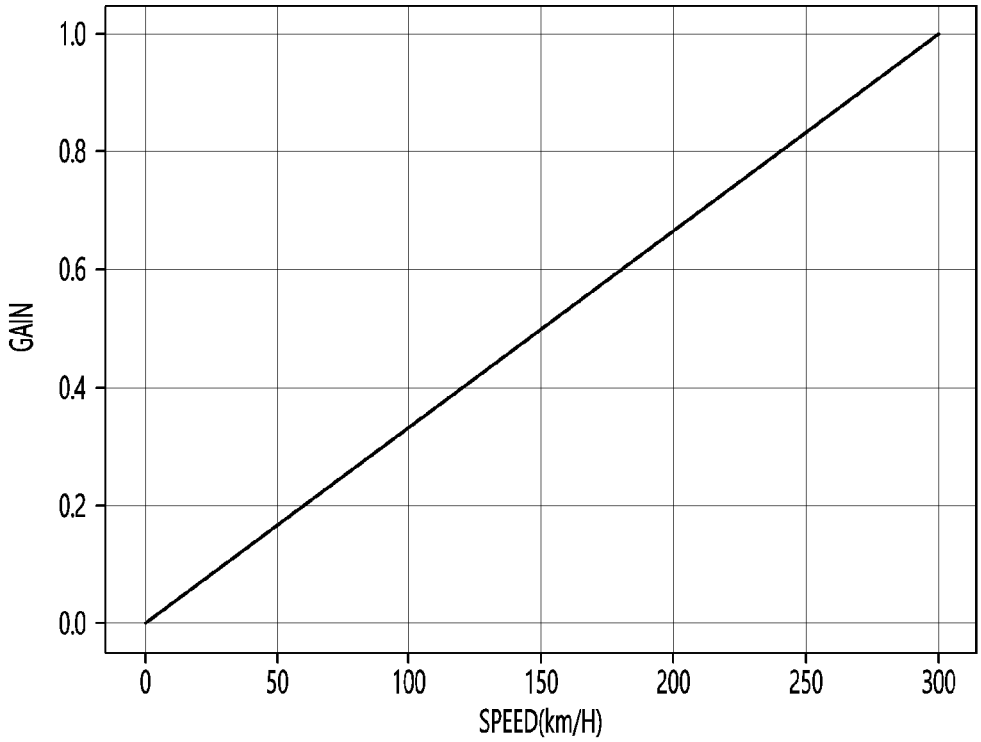

FIGS. 6 to 8 are views illustrating a variation in gain corresponding to state information of a vehicle according to an embodiment of the present invention.

Particularly, FIG. 6 is a graph 600 illustrating a variation in first factor gain according to the RPM, FIG. 7 is a graph 700 illustrating a variation in second factor gain according to the accelerator pedal effort, and FIG. 8 is a graph 800 illustrating a variation in third element gain according to the vehicle speed.

Referring to FIG. 6, it shows the variation in first element gain that varies according to the RPM of the engine.

As the RPM increases, since the explosion noise of the cylinder included in the cylinder module 210 increases, the graph 600 has a form in which a gain value increases accordingly.

Referring to FIG. 7, it shows the variation in second element gain that varies according to the accelerator pedal effort.

As the accelerator pedal effort increases, since the explosion noise of the cylinder increases, the graph 700 has a form in which a gain value increases accordingly.

Referring to FIG. 8, it shows the variation in third element gain that varies according to the vehicle speed.

As the vehicle speed increases, since the explosion noise of the cylinder increases, the graph 800 has a form in which a gain value increases accordingly.

In one embodiment, the processor 290 may acquire a value obtained by multiplying the first element gain value corresponding to the currently measured RPM, the second element gain value corresponding to the currently measured accelerator pedal effort, and the third element corresponding to the currently measured vehicle speed as a final gain value.

In another embodiment, the processor 290 may acquire the sum of the first element gain value corresponding to the currently measured RPM, the second element gain value corresponding to the currently measured accelerator pedal effort, and the third element corresponding to the currently measured vehicle speed as a final gain value.

Again, FIG. 5 will be described.

The processor 290 of the apparatus 200 for synthesizing the engine sound adjusts a size of the explosion sound sample to be superimposed to correspond to the calculated gain (S509).

Here, the described gain may be the final gain value described above.

In an embodiment, the memory 250 may match and store the size of the explosion sound sample corresponding to the gain value.

That is, each of the plurality of gain values and each of the sizes of the plurality of explosion sound sample respectively corresponding to the plurality of gain values may be previously stored in the memory 250.

The processor 290 may search the size of the explosion sound sample corresponding to the calculated gain in the memory and may adjust the stored explosion sound sample to the size of the searched explosion sound sample.

The size of the explosion sound sample may represent a pitch of an explosion sound sample signal.

In an embodiment, the processor 290 may include a built-in amplifier by which the size of the explosive sound sample increases.

The processor 290 of the apparatus 200 for synthesizing the engine sound superimposes the explosion sound sample, which is adjusted in size, with the noise of the corresponding cylinder according to the explosion period (S511).

The processor 290 may synthesize the virtual engine sound by superimposing the sample sound, which is adjusted in size, with the explosion noise of the cylinder according to the explosion period calculated in operation S503.

This will be described with reference to FIG. 9.

Figure 9:
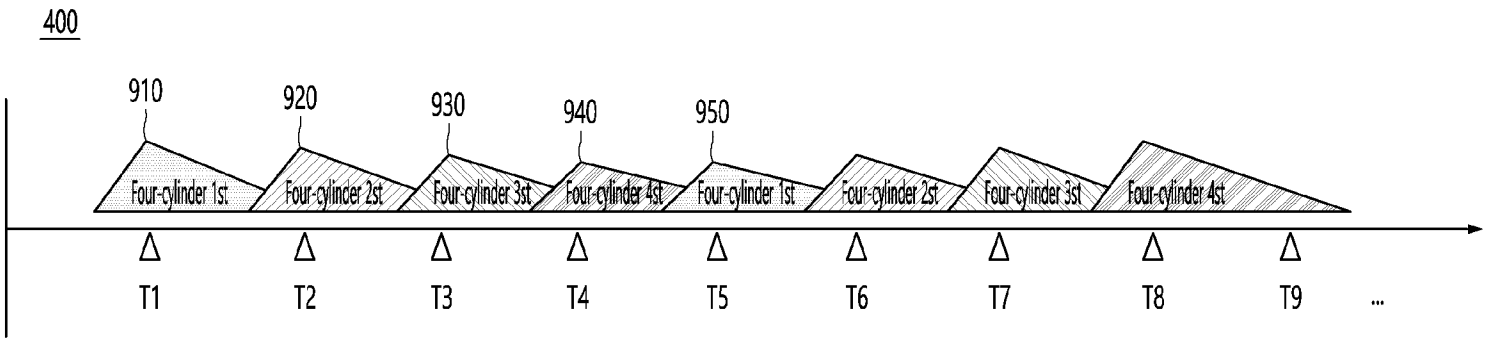
FIG. 9 is a view for explaining an example in which a size of each of explosion sound samples is changed by reflecting vehicle state information according to an explosion period in a four-cylinder type according to an embodiment of the present invention.

FIG. 9 is a view for explaining an example in which a size of each of explosion sound samples is changed by reflecting vehicle state information according to an explosion period in a four-cylinder type according to an embodiment of the present invention.

The four-cylinder type cylinder module 210 may include first to fourth cylinders. In addition, it is assumed that the explosions occur in order of a first cylinder, a second cylinder, a third cylinder, and a fourth cylinder.

The processor 290 may calculate a first gain reflecting the vehicle state information at the first explosion time point T1 and generate a first explosion sound sample 910, which is adjusted in size according to the calculated first gain.

The processor 290 may superimpose the first explosion sound sample 910, which is adjusted in size, with the explosion noise of the first cylinder at a timing of an explosion stroke operation of the first cylinder to output the superimposed result.

The embodiment of FIG. 9 is compared to that of FIG. 4. A first explosion sound sample 410 of FIG. 4 has a predetermined size because the vehicle state information is not reflected.

However, the first explosion sound sample 910 of FIG. 9 reflects the vehicle state information and has a changed size.

Thus, the apparatus 200 for synthesizing the engine sound may output a dynamic engine sound suitable for an actual driving situation.

The processor 290 may calculate a second gain reflecting the vehicle state information at the second explosion time point T2 and generate a second explosion sound sample 920, which is adjusted in size according to the calculated second gain.

The processor 290 may superimpose the second explosion sound sample 920, which is adjusted in size, with the explosion noise of the second cylinder at a timing of an explosion stroke operation of the second cylinder to output the superimposed result.

The processor 290 may calculate a third gain reflecting the vehicle state information at the third explosion time point T3 and generate a third explosion sound sample 930, which is adjusted in size according to the calculated first gain.

The processor 290 may superimpose the third explosion sound sample 930, which is adjusted in size, with the explosion noise of the third cylinder at a timing of an explosion stroke operation of the third cylinder to output the superimposed result.

The processor 290 may calculate a fourth gain reflecting the vehicle state information at the fourth explosion time point T4 and generate a fourth explosion sound sample 940, which is adjusted in size according to the calculated second gain.

That is, the processor 290 may superimpose the fourth explosion sound sample 940, which is adjusted in sized, with the explosion noise of the fourth cylinder at a timing of an explosion stroke operation of the fourth cylinder to output the superimposed result.

Thus, the processor 290 may output virtual engine sounds having different sizes at the timing of the explosion period.

FIG. 5 will be described again.

The processor 290 of the apparatus 200 for synthesizing the engine sound outputs the synthesized virtual engine sound through the sound output unit 270 according to the superimposed result (S513).

As described above, according to the embodiment of FIGS. 5 to 9, the apparatus 200 for synthesizing the engine sound may reflect the vehicle state information to adjust the size of the explosion sound sample, thereby outputting the virtual engine sound suitable for the driver's driving situation.

As the driver outputs the virtual engine sound suitable for the driving situation, auditive fun may increase.

Also, pedestrians around the vehicle or other drivers adjacent to the vehicle may more easily recognize the driving situation of the vehicle.

The above-described present invention may be implemented as a computer-readable code on a computer-readable medium in which a program is stored. The computer readable recording medium includes all types of recording devices in which data readable by a computer system is stored. Examples of the computer-readable recording medium include hard disk drives (HDD), solid state disks (SSD), silicon disk drives (SDD), read only memories (ROMs), random access memories (RAMs), compact disc read only memories (CD-ROMs), magnetic tapes, floppy discs, and optical data storage devices. Also, the computer may include the processor 290 of the apparatus 200 for synthesizing the engine sound.

Thus, the detailed description is intended to be, illustrative, but not limiting in all aspects. It is intended that the scope of the present invention should be determined by the rational interpretation of the claims as set forth, and the modifications and variations of the present invention come within the scope of the appended claims and their equivalents.

The invention claimed is:

1. An apparatus for synthesizing an engine sound, comprising:

a memory configured to store a plurality of combustion sound samples corresponding to respective cylinders among a plurality of cylinders included in an engine;

a sound output unit; and a processor configured to:

determine a combustion period of the engine, acquire a gain based at least in part on vehicle state information comprising at least one of a number of revolutions per minute (RPM) of a crankshaft of a vehicle, a force exerted on an accelerator pedal of the vehicle, or a vehicle speed, wherein the gain is acquired by using a first element gain that varies according to the RPM, a second element gain that varies according to the force exerted on the accelerator pedal, and a third element gain that varies according to the vehicle speed, adjust a size of each of the plurality of combustion sound samples according to the acquired gain, and cause at least one of the stored plurality of combustion sound samples to overlap combustion noises from corresponding cylinders among the plurality of cylinders by outputting, through the sound output unit, a synthesized virtual engine sound according to the determined combustion period and the adjusted size of each of the plurality of combustion sound samples.

2. The apparatus according to claim 1, wherein the combustion period is determined based at least in part on a number of revolutions per second of a crankshaft, a number of revolutions per second per cycle of the crankshaft provided in each of the plurality of cylinders, and a number of revolutions per minute per cycle of the engine.

3. The apparatus according to claim 2, wherein the combustion period is obtained by a formula: ((the number of revolutions per second per cycle of a crankshaft/60)/the number of revolutions per second per cycle of the crankshaft provided in each of the plurality of cylinders) multiplied by a number of combustions of the engine per minute per cycle.

4. The apparatus according to claim 1, wherein the plurality of cylinders comprises a first cylinder, a second cylinder, a third cylinder, and a fourth cylinder, wherein the plurality of combustion sound samples comprises a first combustion sound sample, a second combustion sound sample, a third combustion sound sample, and a fourth combustion sound sample, wherein causing at least one of the stored plurality of combustion sound samples to overlap the combustion noises further comprises:

causing a combustion noise of the first cylinder to overlap the first combustion sound sample corresponding to the first cylinder at a first combustion time point of the first cylinder, causing a combustion noise of the second cylinder to overlap the second combustion sound sample corresponding to the second cylinder at a second combustion time point of the second cylinder, causing a combustion noise of the third cylinder to overlap the third combustion sound sample corresponding to the third cylinder at a third combustion time point of the third cylinder, or causing a combustion noise of the fourth cylinder to overlap the fourth combustion sound sample corresponding to the fourth cylinder at a fourth combustion time point of the fourth cylinder, wherein a time difference between the second combustion time point and the first combustion time point, between the third combustion time point and the second combustion time point, and between the fourth combustion time point and the third combustion time point each correspond to the determined combustion period.

5. The apparatus according to claim 1, wherein the gain is further acquired by multiplying the first element gain by the second element gain and the third element gain.

6. The apparatus according to claim 1, wherein the gain is further acquired by adding the second element gain and the third element gain to the first element gain.

* * * * *